US007066371B2

(12) United States Patent
Villela et al.

(10) Patent No.: US 7,066,371 B2
(45) Date of Patent: Jun. 27, 2006

(54) NAIL GUN DEPTH CONTROL SPACER

(75) Inventors: Edward C. Villela, Leonia, NJ (US); Adem Chich, Kearny, NJ (US)

(73) Assignee: Building Materials Investment Corporation, Wilmington, DE (US)

( * ) Notice: Subject to any disclaimer, the term of this patent is extended or adjusted under 35 U.S.C. 154(b) by 0 days.

(21) Appl. No.: 10/806,690

(22) Filed: Mar. 23, 2004

(65) Prior Publication Data

US 2004/0178248 A1 Sep. 16, 2004

Related U.S. Application Data

(60) Division of application No. 10/376,941, filed on Feb. 28, 2003, now Pat. No. 6,776,322, and a continuation-in-part of application No. 09/757,195, filed on Jan. 9, 2001, now abandoned.

(51) Int. Cl.
*B25C 7/00* (2006.01)

(52) U.S. Cl. ..... 227/142; 227/156; 227/19

(58) Field of Classification Search ..... 227/142, 227/156, 140, 120, 15, 19, 119; 173/171; 29/428, 525.01

See application file for complete search history.

(56) References Cited

U.S. PATENT DOCUMENTS 2,918,675 A * 12/1959 Smith ..... 227/66
3,542,273 A * 11/1970 Hedrick ..... 227/130
4,581,964 A * 4/1986 Takatsuru ..... 81/464
5,165,588 A * 11/1992 Rowland ..... 227/147
5,281,065 A 1/1994 Wu ..... 411/258
5,405,071 A * 4/1995 Baugus ..... 227/140
5,452,944 A 9/1995 Bear ..... 301/35.624
5,484,094 A 1/1996 Gupta ..... 227/113
5,528,872 A 6/1996 Rotter ..... 52/748.1
5,649,661 A * 7/1997 Masuno et al. ..... 227/8
5,743,455 A * 4/1998 Holliday ..... 227/142
6,080,116 A * 6/2000 Erickson et al. ..... 600/573
6,695,192 B1 * 2/2004 Kwok ..... 227/8
6,776,322 B1 * 8/2004 Villela et al. ..... 227/142

OTHER PUBLICATIONS

Copy of Original Nail Gun Label, fax date–stamped Mar. 20, 2001 from product that was commercially launched in early 2001.
Photograph of Nail Gun Adapter.

* cited by examiner

*Primary Examiner*—Stephen F. Gerrity
*Assistant Examiner*—Paul Durand
(74) *Attorney, Agent, or Firm*—William J. Davis; Imre Balogh

(57) ABSTRACT

A nail gun and depth control spacer assembly for ejecting nails into a substrate which contains two or more layers of roofing materials one of which is a compressible fibrous layer. The nails penetrate the substrate but are prevented by the depth control spacer from permanently compressing the compressible fibrous layer which springs back to is original thickness after completion of the nailing process. The depth control spacer, attached to the base of the nail gun, is of semi-oval configuration having a pressure sensitive layer and a solid layer, is provided with an oval cavity in its center portion through which the nails are ejected into the substrate.

5 Claims, 5 Drawing Sheets

NAIL GUN DEPTH CONTROL SPACER

This is a division, of application Ser. No. 10/376,941, filed on Feb. 28, 2003, now U.S. Pat. No. 6,776,322 and is a CIP of application Ser. No. 09/757,195, filed Jan. 9, 2001 now abandoned.

BACKGROUND OF THE INVENTION

1. Field of the Invention

The present invention relates to a nail gun in general, and more particularly, to a nail gun attachment in the form of a spacer which prevents compressing and crushing a building material when installed over a structure using nails.

2. Reported Developments

Nail guns are well-known in the prior art and their use in building construction greatly improves the speed, safety and accuracy of attaching together construction elements by the use of nails. Examples of nail guns can be found in U.S. Pat. Nos. 5,261,588, 5,180,091 and 4,570,840.

Briefly described, a nail gun comprises:

a driving cylinder for ejecting nails upon actuation thereof;

a handle of a generally rectangular, closed loop configuration coupled to a peripheral side wall; and a trigger mounted on an intersection between the driving cylinder and the handle for selectively actuating the driving cylinder.

Nail guns provide for easy, convenient and fast delivery of nails into building materials for fastening such materials to each other. Certain building materials, however, require attachment to nail guns for affixing layers of sheet materials together without damaging the materials intended for special uses, as exemplified by the following.

In the building industry when two sheets of materials are being fastened together it is necessary to space the two sheets of materials at a pre-determined distance apart from each other, such as when installing dry walls, placing foam insulation between vinyl or aluminum siding panels and outer wall sheathing, or installing a roof ridge vent using a synthetic fiber matting covered by asphalt cap shingles. The nails used, without a provision for spacing the sheet materials apart from each other, tend to crush the soft materials or cause indentations around the nails in the composite materials. Such indentation vary from minor indentation resulting in less than aesthetically pleasing appearance to the reduction in insulating efficacy of the composite material. An example of the latter occurrence is the installation of a mat made of randomly aligned synthetic fibers joined by phenolic or latex bonding which is heat cured to provide the mat with varying mesh. This material is sold by GAF Materials Corporation, and is available under the name COBRA(c) Ridge Vent and is described in U.S. Pat. No. 5,167,579. When the COBRA(c) mat is nailed to the ridge vent, then covered by shingles using manual installation techniques, or nail guns without having a means to keep the two layers spaced from each other the mat is compressed by being crushed by the nails resulting in loss of the R value of the mat.

U.S. Pat. No. 5,511,918 discloses a nail used manually or with a pneumatic gun for securing two materials together spaced by an interposed resilient material. The nail has a head at one end, a shaft extending from the head and terminating in a sharp point. The nail is equipped with a sleeve having a cylindrical center portion and a pair of frusto-concical tapered portion. The sleeve surrounds the shaft and has a length in excess of the resilient material and less than the length of the shaft.

The method of using the nail equipped with the sleeve to affix two sheets together interposed by a resilient layer includes the steps of:

laying the first sheet on a supportive substrate;

laying the resilient layer on top of the first sheet;

laying the second sheet on top of the resilient material;

driving the point of the nail through the second sheet, the resilient layer and into the first sheet.

The cutting edge of the sleeve cuts the second sheet and the resilient layer. The cutting edge of the sleeve stops at the first sheet without penetrating the first sheet for the reason that the length of the sleeve is no more than the combined thickness of the first sheet and the resilient layer. As a result of the limiting length of the sleeve the resilient layer is not crushed or compressed by the nail. However, it will be noted by those skilled in the art that while this invention greatly reduces the compression of the resilient layer in the vertical direction, the sleeve exerts a compression or crushing force in the lateral direction. The extent of such compressive or crushing forces is proportional to the thickness of the sleeve. An object of the present invention is to reduce such compressive or crushing forces both in the vertical and the lateral directions.

U.S. Pat. No. 5,564,614 is directed to a nailing depth adjusting mechanism for a pneumatic nail gun comprising: a firing control strip fastened to the gun and driven to release the firing pin thereof; and a wheel for adjusting the nailing depth of the gun.

The present invention utilizes a concept which is different from those of the prior art in providing an attachment to a nail gun by which compression and/or crushing a fibrous material interposed between two sheets is prevented.

SUMMARY OF THE INVENTION

In accordance with the present invention a nail gun and depth control spacer assembly is provided for ejecting nails into a substrate, said substrate containing two or more layers of roofing materials at least one of which is compressible, wherein said nails penetrate the substrate but are prevented from permanently compressing said compressible layer, comprising:

a nail gun including a driving cylinder having an inlet and outlet containing nails therein, a trigger mechanism for selectively actuating the driving cylinder, and a base portion associated with said outlet; and a depth control spacer attached to said base portion of the nail gun to permanently remain thereon after discharge of said nails from said nail gun, wherein said depth control spacer having a semi-oval configuration is composed of a pressure sensitive adhesive layer, and a rigid or semi-rigid layer of metal or polymeric material.

The pressure sensitive layer is covered with a release paper which allows storing of the depth control spacer prior to attachment thereof to a nail gun. The configuration of the depth control spacer is such that it allows attachment thereof to most of the commercially used nail guns. While the depth control spacer described herein is preferably attached to the base of the nail gun by the pressure sensitive layer, other means of attachment may also be used within the inventive concept of the invention, such as screws and clips.

The preferred embodiment of the depth control spacer being a composite of two layers having a semi-oval configuration comprising:

a distal end, a proximal end and a center portion;

a horizontal top portion at the distal end;

a first vertical side portion extending from the horizontal top portion towards the proximal end;

a second side portion extending from the first vertical side portion towards the proximal end at a slight angle from the vertical portion towards the center;

a third side portion at the proximal end extending from the second side portion and enclosing an obtuse angle forming the tip of the depth control spacer; and an oval cavity having a longitudinal axis and a transverse axis in the center portion of the spacer, the longitudinal axis of which points in the vertical direction, and the transverse axis of which points in the horizontal direction.

DETAILED DESCRIPTION OF THE INVENTION

Figures 1, 8:
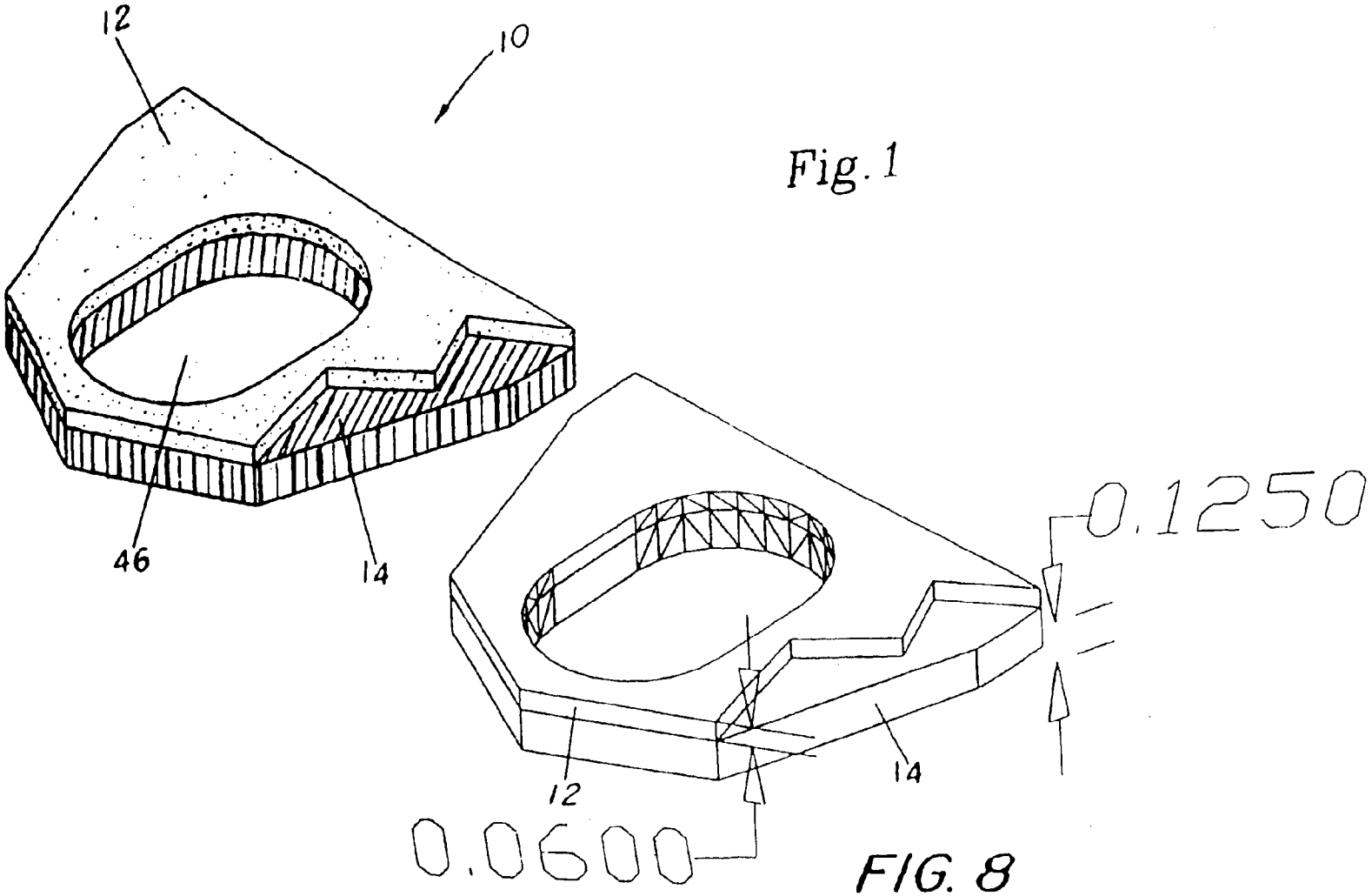
FIG. 1 is a perspective view of the depth control spacer of the present invention in which the top layer is partially cut away.
FIG. 8 is a partial side and top plan view of the depth control spacer showing the thickness of the top layer and the bottom layer.

FIG. 1 is a perspective view of the depth control spacer, generally designated by the numeral 10, comprising a top layer 12 of pressure sensitive adhesive, and a bottom layer 14 of a hard or semi-flexible polymeric material. The top layer in FIG. 1 is partially cut away to illustrate the composition of the spacer. As used herein, the word "spacer" denotes a three-dimensional object which separates two points or surfaces from each other and maintains them apart for a given time period. The bottom layer of the depth control spacer is made of metal, such as steel, copper and aluminum or a polymeric material, such as polyethylene, polypropylene, polystyrene, acrylic polymers and methacrylic polymers. The bottom layer preferably is stiffer than the top layer and can be semi-rigid or rigid. Preferably, the bottom layer is made of thermoplastic materials of sufficient thickness which together with the pressure sensitive layer provides the desired thickness in between a nail head and a cap shingle wherein the bottom layer and the pressure sensitive adhesive layer are described later. The pressure sensitive adhesive used as the top layer of the depth control spacer can be any pressure sensitive adhesive known in the prior art that provides the required adhesion or "tackiness" so that it adheres to the bottom layer of the depth control spacer as well as to the base of the nail gun with which it is used. A release sheet covers the top of the pressure sensitive layer (not shown) prior to attachment of the depth control spacer to the base of the nail gun. In a preferred embodiment, the depth control spacer comprises a pressure sensitive layer having a thickness from 0.008"–0.06" and a rigid or semi-rigid layer having a thickness from 0.125"–0.250". The thickness of the depth control spacer consisting of the thickness of the pressure adhesive layer and the thickness of the rigid or semi-rigid layer predetermines the distance between the nail head and the cap shingle.

Figure 2:
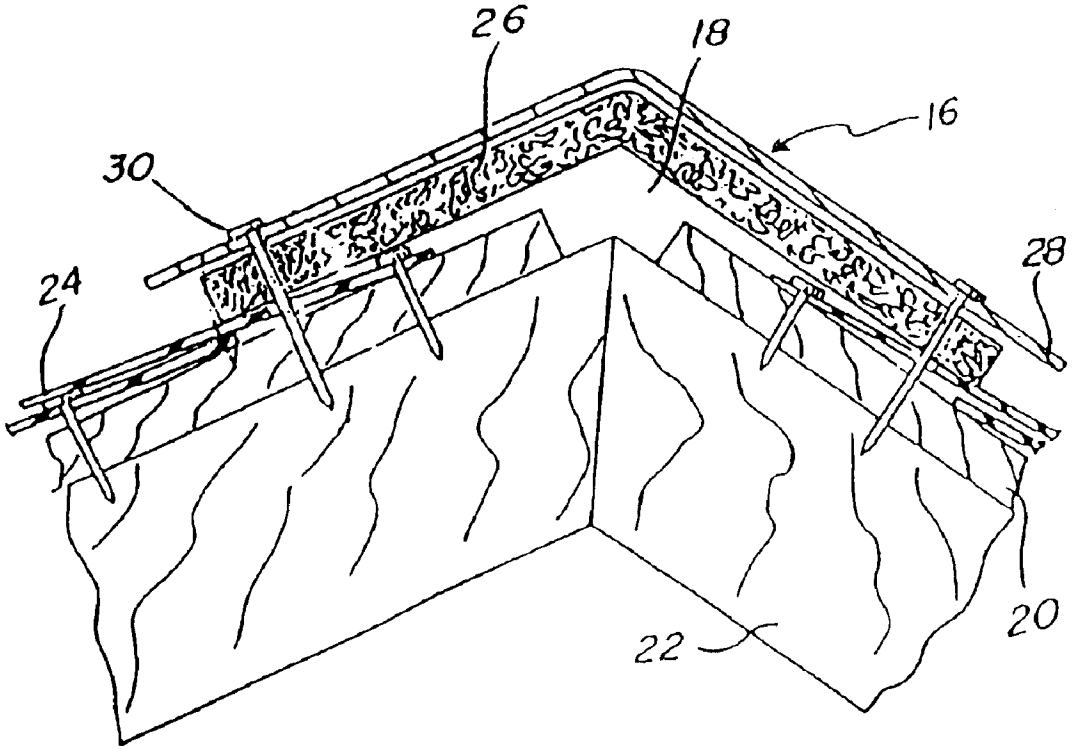
FIG. 2 is a side elevational view of a ridge vent system showing layers of roofing materials attached to a substrate with nails which were propelled by a nail gun, said nail gun having been equipped with the depth control spacer.

FIG. 2 is a side sectional view of layers of a built-up roof showing a nail which has been inserted by a nail gun into the layers. In some detail, FIG. 2 shows venting system 16 used to vent hot air from the attic through an open slot 18 in the ridge of a roof. The slot is formed by cutting a sheeting material, such as an upper sheeting panel 20, about ¾" short of the ridge crest formed by the rafters 22. Roof shingles are laid in overlapping rows tip to the open slot 18. A unitary mat 26 of randomly aligned synthetic fabrics is laid on the top of the upper row sheeting panel 20. The mat is about ¾" thick. It runs the length of the slot extending evenly on each side. Cap shingles 28 are then laid over the mat and are secured by driving a nail through the cap shingle 28, mat 26, and the roof shingles 24 into the underlying sheathing 20 and rafters 22. Nail 30 is driven into the layers from a pneumatic nail gun the base of which carries the depth control spacer of the present invention. The dimensions of the depth control spacer used in the venting system are described in connection with the following FIGS. 3–6 in which the dimensions are measured in inches.

FIGS. 3–7 show top plan views of the depth control spacer. Generally characterized, the circumference of the depth control spacer is semi-oval, i.e., an oval shaped body having a longitudinal axis and a transverse axis is cut into two equal halves along the transverse axis. The top plan views in FIGS. 3–7 show the bottom half of the oval shaped body. The center portion of the depth control spacer is provided with an oval cavity the longitudinal axis of which is vertically oriented and the transverse axis of which is horizontally oriented.

Figures 3, 4, 5:
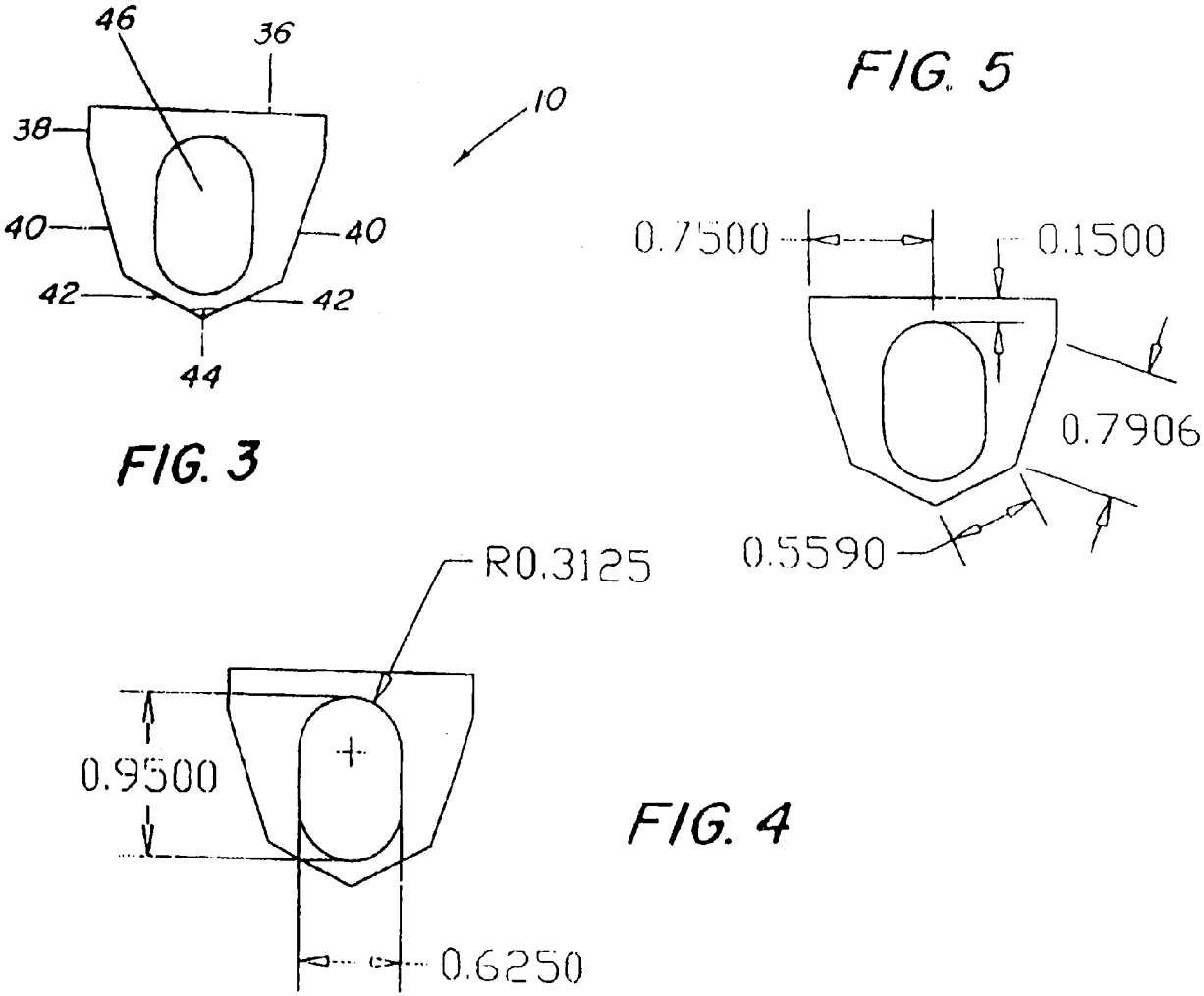
FIG. 3 is a top plan view of the depth control spacer showing top and side portions thereof and the oval cavity therein.
FIG. 4 is a top plan view of the depth control spacer showing the longitudinal diameter, the transverse diameter and the radius of the area of the oval cavity thereof.
FIG. 5 is a top plan view of the depth control spacer showing the length of the horizontal top portion; the length of the second side portion, and the space between the horizontal top portion and the distal end portion of the oval cavity thereof.

Referring to FIG. 3, depth control spacer 10 comprises:

a horizontal top portion 36 at the distal end;

a first vertical side portion 38 running from the top portion towards the proximal end;

a second side portion 40 running from the vertical side portion towards the proximal end at a slight angle from the vertical;

a third side portion 42 at the proximal end extending from the second side portion and enclosing an obtuse triangle forming the tip of the depth control spacer; and a centrally positioned oval cavity 46 in the depth control spacer, the longitudinal axis of which is pointed in a vertical direction.

The cavity is spaced from the top, side and bottom portions of the periphery of the depth control spacer.

Figure 7:
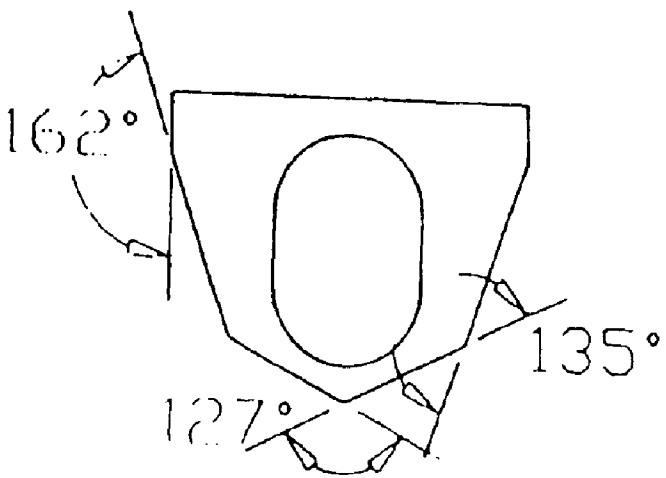
FIG. 7 is a top plan view of the depth control spacer showing the angle enclosed by the first side portion and the second side portion on each side of the spacer, the angle enclosed the second side portion and the third side portion, and the angle enclosed by the two third side portions.
Figure 6:
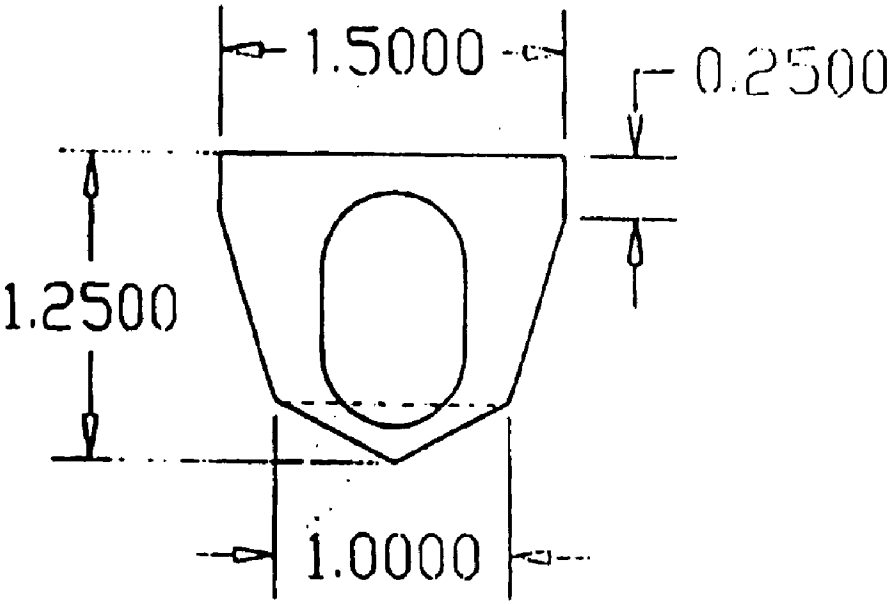
FIG. 6 is a partial top plan view of the depth control spacer showing the length of the horizontal top portion; the length of the first vertical side portion, and total length from the horizontal top portion to the tip of the third side portion, and the distance between the points where the second and third side portions meet on each side thereof.

The dimensions of the depth control spacer are shown in FIGS. 4–8, wherein the numerals denote inches. While the numeral denotes actual dimensions, the scale of the drawing is a close approximation of the numerals. FIGS. 5–7 are top plan views while FIG. 8 is a partial side and top plan view of the depth control spacer.

FIG. 4 shows the following: the longitudinal diameter of the oval cavity is 0.9500"; the transverse diameter of the oval cavity is 0.6250"; and the radius of the arc at the distal and proximal ends of the cavity is 0.3125".

FIG. 5 shows the following: half of the length of horizontal top portion 36 of the depth control spacer is 0.7500" and, therefore, the full length of the horizontal top portion is 1.5000" which is also shown in FIG. 6; the distal arc of the cavity is spaced from the horizontal top portion at 0.1500"; second side portion 40 has a length of 0.7906"; the third side portion has a length of 0.5590".

FIG. 6 shows the following: the length of the horizontal top portion is 1.5000"; the length of the first vertical side portion 38 is 0.2500"; the total vertical length of the depth control spacer from the horizontal top portion to the tip of the third side portion is 1.5000"; and the distance shown by the dotted line between the points where the second and third side portions meet on each side of the depth control spacer is 1.000".

FIG. 7 shows the following: the angle enclosed by the first side portion 38 and the second side portion 40 is 162° on each side of the depth control spacer, the angle enclosed by the second side portion 40 and the third side portion 42 is 135° on each side of the depth control spacer; and the angle enclosed by the two third side portions 44 is 127°.

FIG. 8 shows that top layer 12 of the depth control spacer, which is the pressure sensitive adhesive layer, has a thickness of 0.0600"; and the bottom layer 14, which is the metal or polymeric layer, has a thickness of 0.1250".

Figure 9:
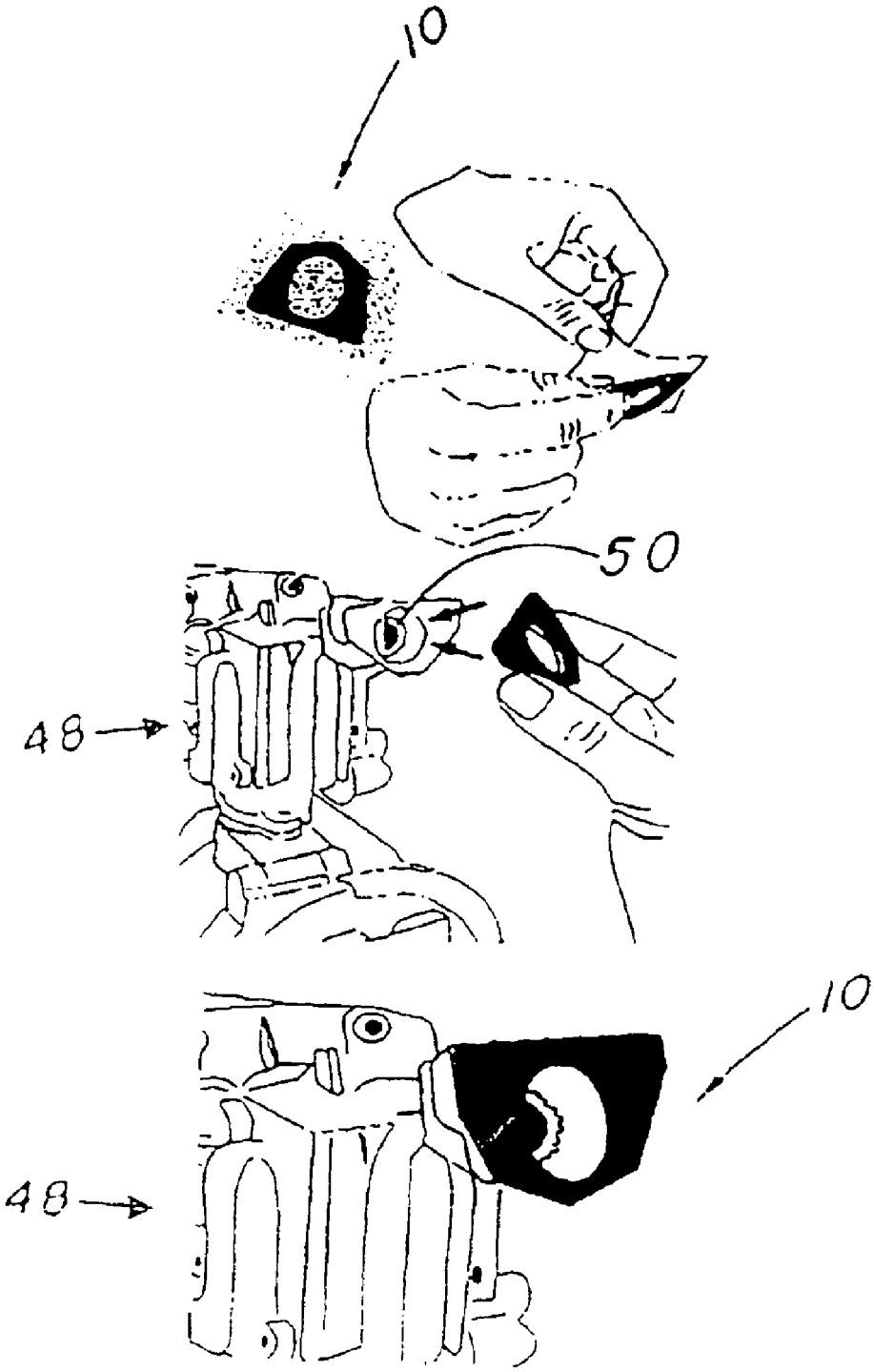
FIG. 9 illustrates the attachment of the depth control spacer to the base of a nail gun, the nail gun being shown in phantom.

FIG. 9 shows the method of installation of the depth control spacer 10 on the pneumatic nail gun 48 having a nail hole exit 50, wherein the nail gun, the nail hole exit as well as the hands of the installer are shown in phantom. The method includes the steps of:

disconnecting the air supply line from the nail gun;

removing the release paper or film from the depth control spacer to expose the pressure sensitive layer;

aligning the depth control spacer so that the nail hole exit is inside the oval cavity of the depth control depth control spacer against the base of the nail hole exit for adhesive bonding thereof;

inserting the coil of 1¾" roofing nails into the nail gun; and reconnecting the air supply line to the nail gun.

PARTS LIST

Depth control spacer, generally designated 10
Top or adhesive layer of depth control spacer 12
Bottom layer of depth control spacer 14
Venting system 16
Open slot in venting system 18
Upper row sheeting panel 20
Rafters 22
Roof shingles 24
Unitary fibrous mat 26
Cap shingles 28
Nail 30
Horizontal top portion of depth control pacer 36
First vertical side portion of depth control spacer 38
Second side portion of depth control spacer 40
Third side portion of depth control spacer 42
Tip at the proximal end of depth control spacer 44
Oval cavity in depth control spacer 46
Nail gun 48
Nail hole exit 50

Various modifications of the present invention disclosed will become apparent to those skilled in the art. This invention is intended to include such modifications to be limited only by the scope of the claims.

What is claimed is:

1. A nail gun and depth control spacer assembly for ejecting nails into a substrate, said substrate containing two or more layers of roofing materials at least one of which is compressible, wherein said nails penetrate the substrate but are prevented from permanently compressing said compressible layer, comprising:

a nail gun including a driving cylinder having an inlet and outlet containing nails therein, a trigger mechanism for selectively actuating the driving cylinder, and a base portion associated with said outlet;

a depth control spacer attached to said base portion of said nail gun to permanently remain thereon after discharge of said nails from said nail gun, wherein said depth control spacer having a semi-oval configuration composed of a pressure sensitive adhesive layer having a thickness of about 0.008" to 0.06" and a rigid layer of metal or polymeric material having a thickness of about 0.125" to 0.250" comprising:

a distal end, a proximal end and a center portion;

a horizontal top portion at the distal end;

a first vertical side portion extending from the horizontal top portion towards the proximal end;

a second side portion extending from the first vertical side portion towards the proximal end at a slight angle from the vertical towards the center portion;

a third side portion at the proximal end extending from said second side portion and enclosing an obtuse angle forming the tip of the spacer; and an oval cavity having a longitudinal axis and a transverse axis in the center portion of the depth control spacer, the longitudinal axis of which points in the vertical direction, and the transverse axis of which points in the horizontal direction, wherein said oval cavity has a longitudinal diameter of about 0.95" a transverse diameter of about 0.62", and an arc radius of about 0.3".

2. The nail gun and depth control spacer assembly of claim 1 wherein said nail gun is a pneumatic nail gun.

3. The nail gun and depth control spacer assembly of claim 1 wherein said rigid layer of metal is selected from the group consisting of steel, copper and aluminum.

4. The nail gun and depth control spacer assembly of claim 1 wherein said rigid layer is a thermoplastic material.

5. The nail gun and depth control spacer assembly of claim 1 wherein said rigid layer is a polymeric material selected from the group consisting of polyethylene, polypropylene, polystyrene, acrylic polymers and methacrylic polymers.

* * * * *